US006983690B2

(12) United States Patent
Eppinger

(10) Patent No.: US 6,983,690 B2
(45) Date of Patent: Jan. 10, 2006

(54) TRANSFER HEAT PRESS

(75) Inventor: Otto Richard Eppinger, Braeside (AU)

(73) Assignee: Reefdale PTY LTD, Victoria (AU)

( * ) Notice: Subject to any disclaimer, the term of this patent is extended or adjusted under 35 U.S.C. 154(b) by 0 days.

(21) Appl. No.: 10/814,628

(22) Filed: Apr. 1, 2004

(65) Prior Publication Data

US 2004/0244617 A1 Dec. 9, 2004

(30) Foreign Application Priority Data

Jun. 3, 2003 (AU) ..... 2003902747
Nov. 12, 2003 (AU) ..... 2003906205

(51) Int. Cl.
*B30B 15/04* (2006.01)
*B30B 15/06* (2006.01)

(52) U.S. Cl. ..... 101/287; 101/114

(58) Field of Classification Search ..... 101/9, 101/10, 11, 27, 31, 38, 476, 287; 100/264; 156/583.1, 230; 264/323, 553; 425/383.1
See application file for complete search history.

(56) References Cited

U.S. PATENT DOCUMENTS 3,756,145 A * 9/1973 Amacker ..... 100/269.05
3,795,189 A 3/1974 Jaffa
3,979,248 A 9/1976 Kussmaul
4,030,962 A * 6/1977 Fitzwater ..... 156/583.1
4,058,055 A * 11/1977 Douglas ..... 101/10
4,305,268 A * 12/1981 Hahn ..... 72/45
4,386,993 A 6/1983 Matsuo
4,706,565 A * 11/1987 Martin et al. ..... 101/151
4,963,208 A 10/1990 Muncy et al.
5,031,527 A 7/1991 Eppinger
5,435,883 A 7/1995 Myers
5,474,633 A 12/1995 Myers
5,595,113 A 1/1997 Daniel et al.
5,678,482 A 10/1997 Daniel et al.
5,755,845 A * 5/1998 Woodward et al. ..... 65/102
5,811,041 A * 9/1998 Snow ..... 264/102
5,913,264 A 6/1999 Eppinger
5,970,874 A 10/1999 Bill
6,210,531 B1 * 4/2001 Bradford ..... 162/218
6,474,975 B2 * 11/2002 Bibeau ..... 425/383

FOREIGN PATENT DOCUMENTS

JP 08057699 A * 3/1996
JP 11226796 A * 8/1999

* cited by examiner

*Primary Examiner*—Daniel J. Colilla
(74) *Attorney, Agent, or Firm*—Connolly Bove Lodge & Hutz LLP

(57) ABSTRACT

A transfer heat press which is intended for use with a rotary screen printing machine, incorporates a C shaped frame mounted on a support and moveable vertically relative to said support. A heater platen is mounted to the top of the C frame. A lower platen adapted to support the pallet of the rotary screen printing machine is mounted on the lower part of the C frame. The lower platen is moveable toward the upper platen. The lower platen applies a force to the underside of the pallet arm of a screen printing machine which results in the platen frame being allowed to move downwardly. This downward movement is guided and cushioned by a pneumatic or hydraulic spring. This arrangement means that the force on the pallet arm is equal to the weight of the platen frame less the upthrust of the pneumatic hydraulic ram. This reduces the risk of damage to the pallet arm.

5 Claims, 4 Drawing Sheets

TRANSFER HEAT PRESS

This invention relates to a heat press for transfer printing of garments particularly in association with a rotary screen printing machine.

BACKGROUND TO THE INVENTION

Heat presses for transfer printing are known. U.S. Pat. No. 4,386,993 discloses a press in which the upper platen moves relative to the lower platen by way of a cam and rocking member.

U.S. Pat. No. 3,979,248 discloses a decal press with a motor driven upper platen.

U.S. Pat. No. 5,435,883 discloses a hand operated press with adjustment for the gap between the platens.

U.S. Pat. No. 5,474,633 discloses a press with a pneumatic engager to press the upper platen onto the lower platen and a timer mechanism.

U.S. Pat. No. 4,963,208 discloses a system for applying a decorative device using a swingable upper platen.

Often transfers are applied as part of a process of screen printing an ornamental pattern onto a garment. The heat press is positioned relative to one print station of a rotary printing machine of the type described in U.S. Pat. Nos. 3,795,189 and 5,031,527 which are examples of the type of machines used in screen printing garments. The garment is supported on a pallet of the screen printing machine and the pallet arm swings the pallet with the garment into position between the upper and lower platens of the heat press.

In the prior art heat presses the pressing force is applied to the upper platen and the lower platen may not be at an appropriate height to properly support the pallet arm. The forces applied may damage the pallet arm or bend it out of shape sufficient to impede the printing performance of the machine.

One attempt to overcome this problem is disclosed in U.S. Pat. No. 5,970,874 where both the upper and lower platens are movable relative to the heat press frame so that the upper and lower platens simultaneously press the pallet. In practice however it is difficult to achieve simultaneous contact and undue pressure on the pallet arms still occurs.

It is an object of this invention to overcome this problem.

BRIEF DESCRIPTION OF THE INVENTION

To this end the present invention provides a transfer heat press which includes a) a platen frame mounted on a support and moveable vertically relative to said support b) an upper platen mounted to the platen frame c) a lower platen mounted on the platen frame the lower platen being moveable toward the upper platen d) control means which allows the frame to move downwardly when the lower platen is raised toward the upper platen.

The lower platen applies a force to the underside of the pallet arm of a screen printing machine which results in the platen frame being allowed to move downwardly. This downward movement is preferably guided and cushioned by a pneumatic or hydraulic spring. This arrangement means that the force on the pallet arm is equal to the weight of the platen frame less the upthrust of the pneumatic or hydraulic spring and the risk of damage to the pallet arm is minimized. The pressure applied by the upper platen to a garment is counterbalanced by the upward force exerted by the lower platen. This is a more reliable means of ensuring that the pressure on the pallet is always countered by the lower platen than that provided by U.S. Pat. No. 5,970,874.

Preferably the platen frame is C shaped and the upper platen is fixed to the top of the C and the lower platen is able to be raised toward the upper platen. The C frame and the upper and lower platens are supported by a support frame which may include hydraulic or pneumatic lifting rams to initially place the C frame around the pallet of the screen printing the machine. Once the heat press is actuated the lower platen is raised to contact the pallet arm and the C frame is allowed to slide downwardly so that the upper platen contacts the garment on the pallet. The upper platen is heated to assist the transfer printing.

DETAILED DESCRIPTION OF THE INVENTION

A preferred form of the invention is illustrated in the enclosed drawings in which FIG. 1 is a rear perspective view of the heat press of this invention;

The embodiment illustrated is a mobile heat press station which may be used with a rotary or oval screen printing machine of the kind described in U.S. Pat. Nos. 5,031,527, 5,595,113, 5,678,482, 5,913,264 and 5,970,874 or any other printing machine with a cantilevered pallet.

Figure 1:
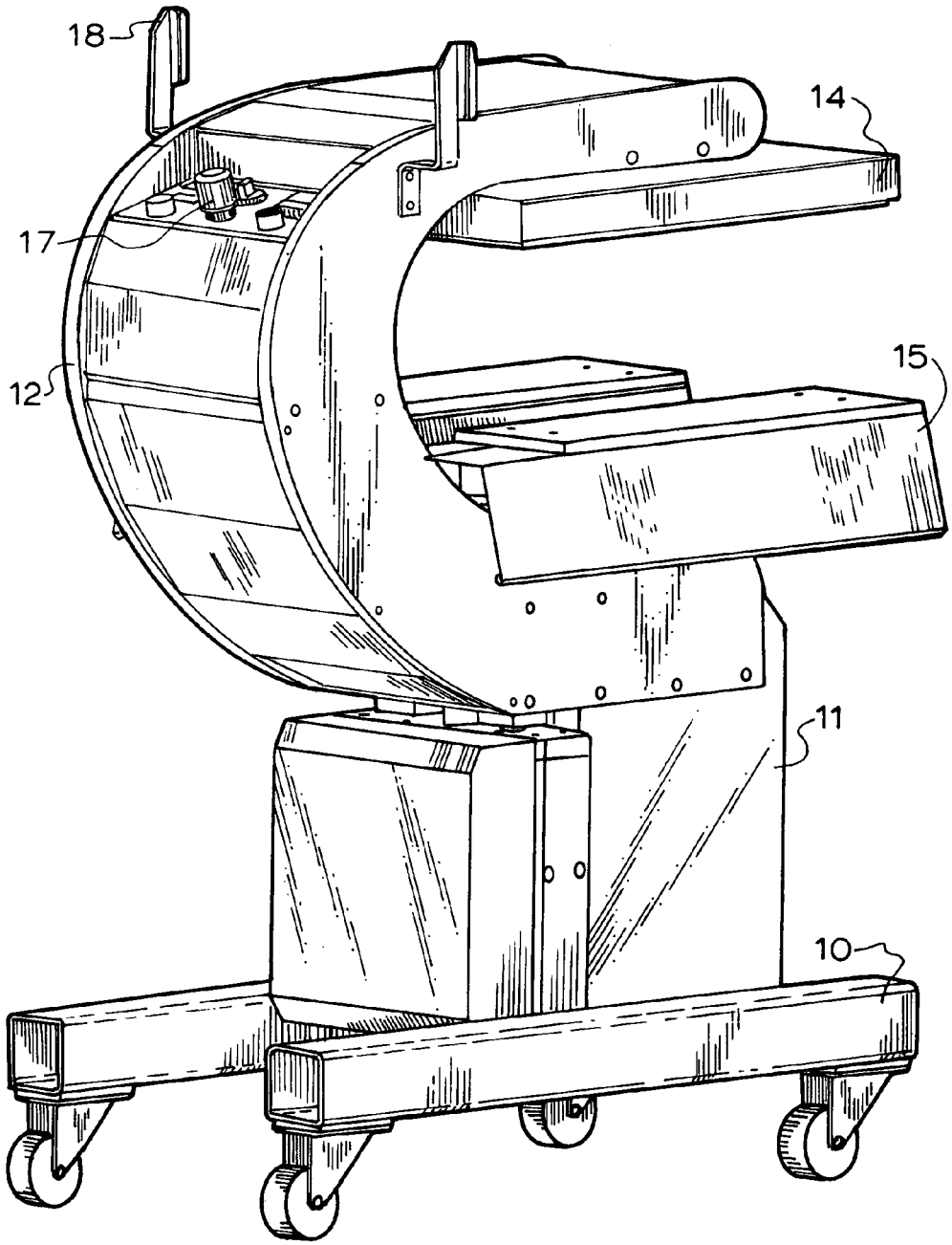
Figure 2:
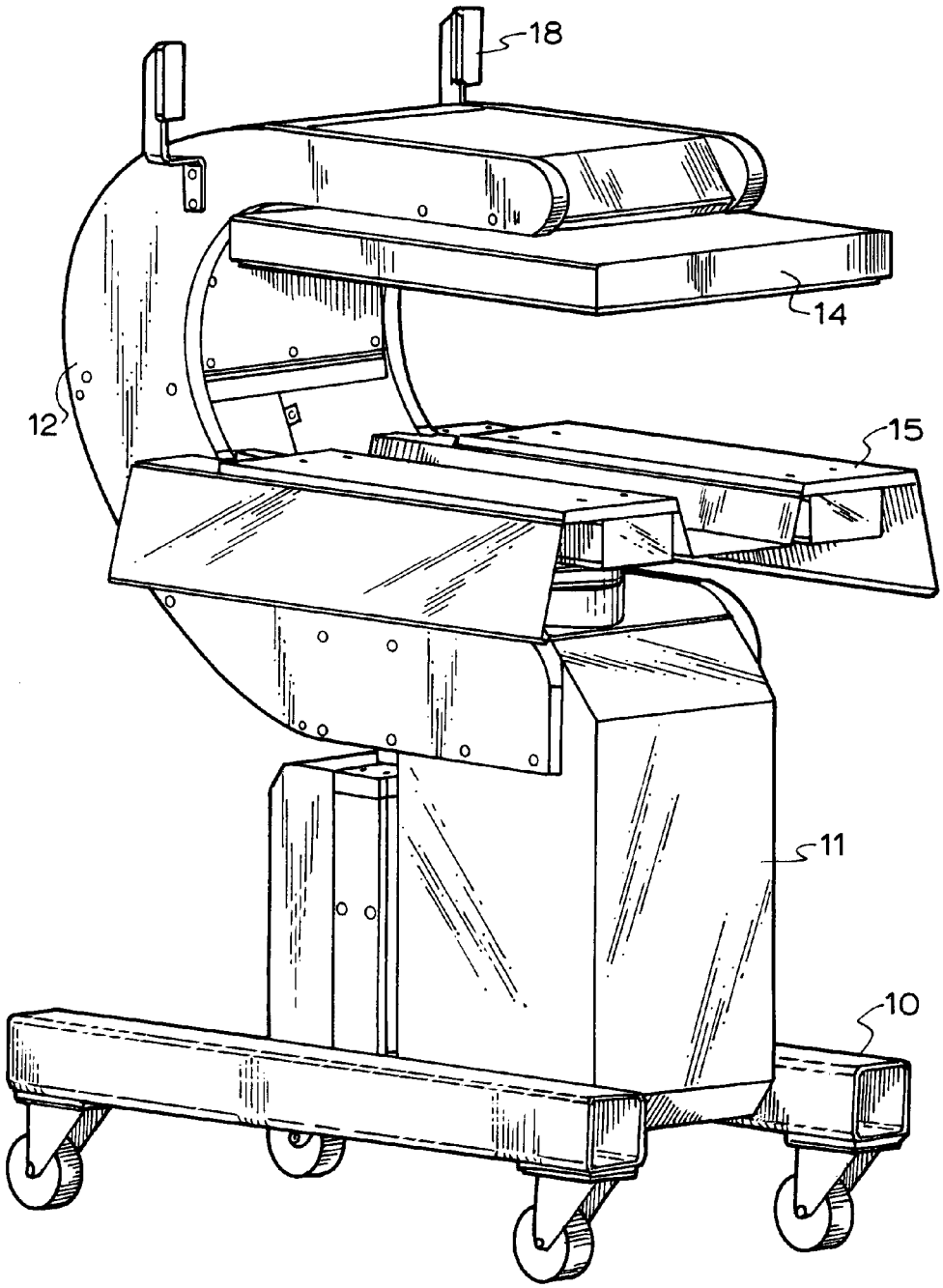
FIG. 2 is front perspective view of the heat press of this invention.
Figure 3:
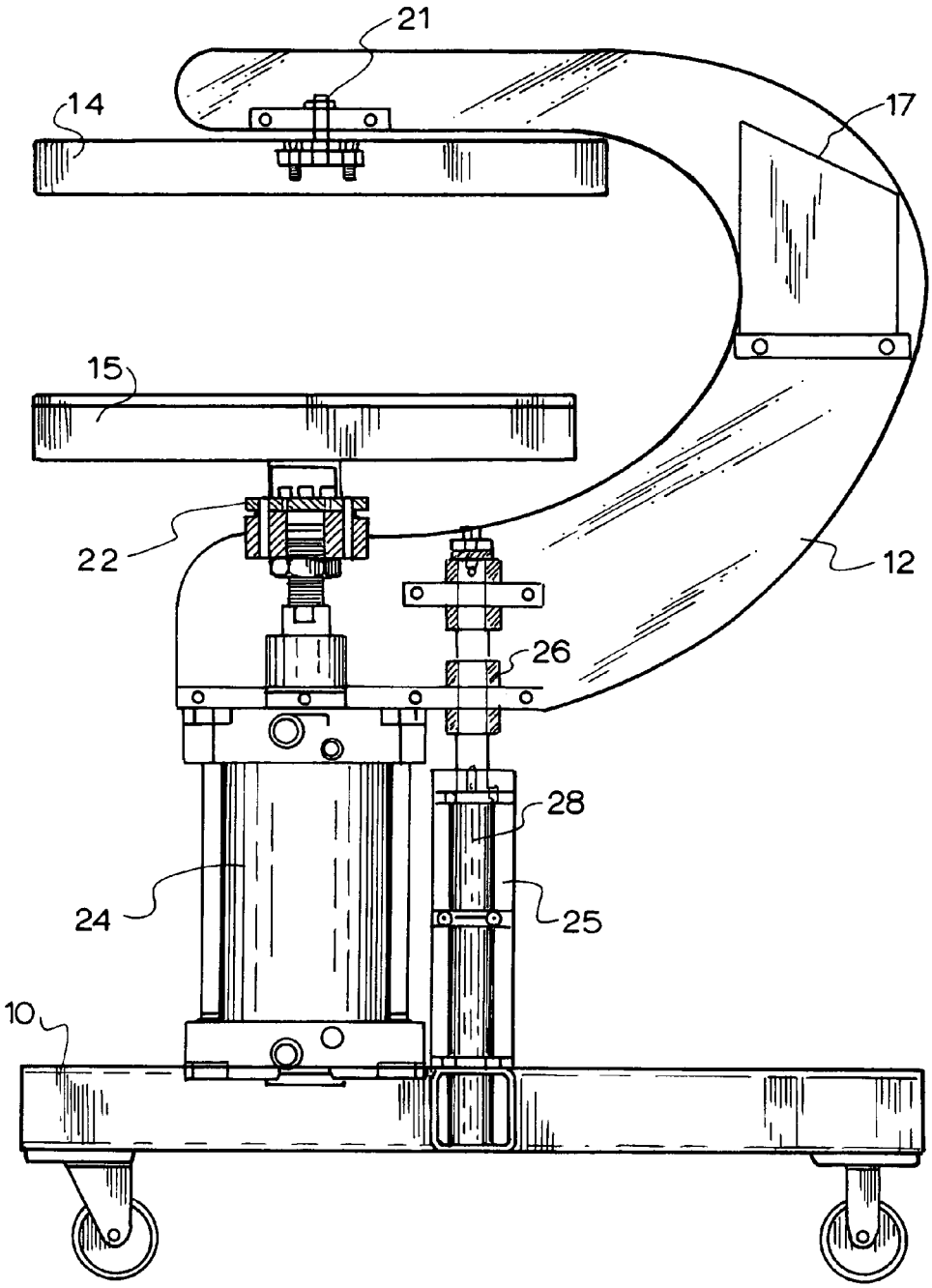
FIG. 3 is a schematic side elevation of the invention.
Figure 4:
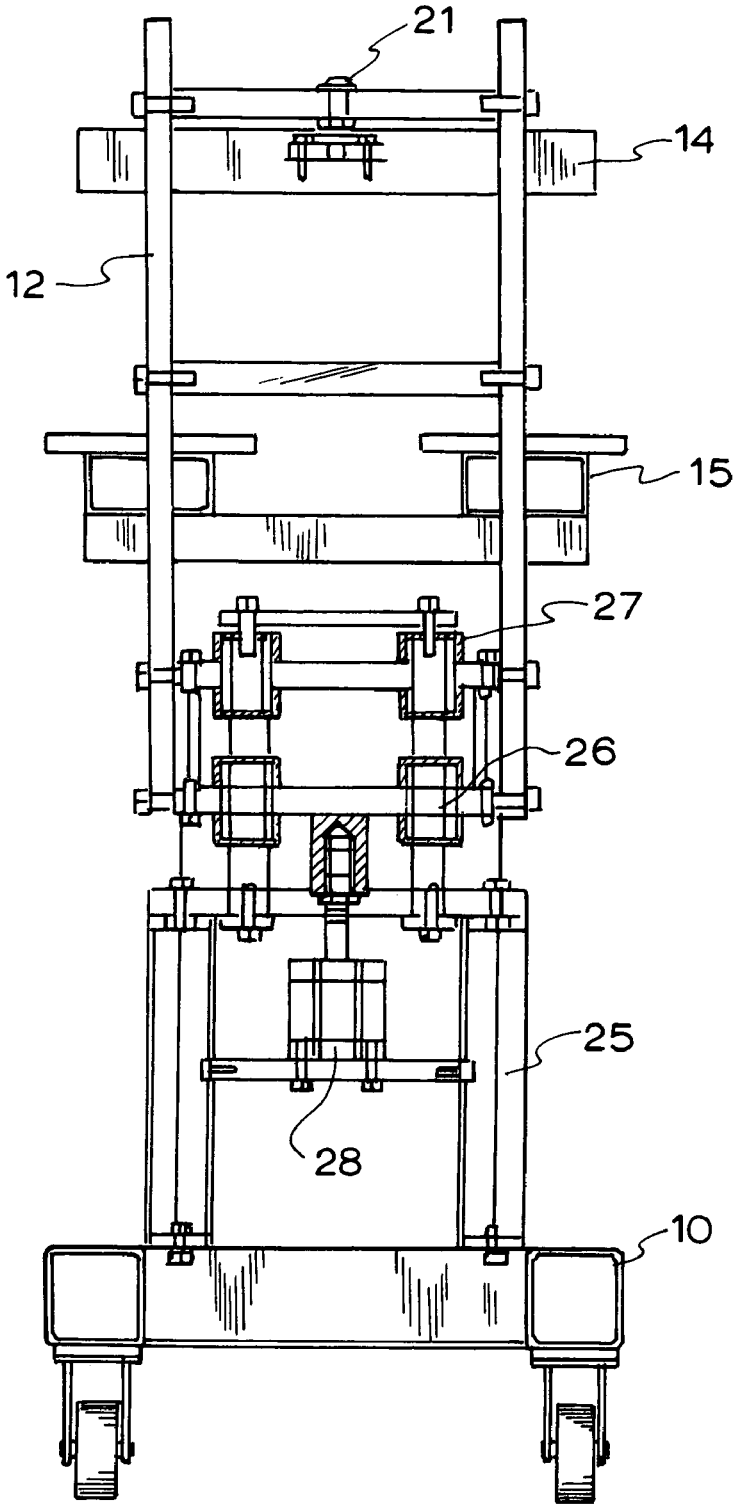
FIG. 4 is a schematic rear view of the invention.

The machine consists of a wheeled base 10 mounted on which is the support frame 11. The C frame 12 is mounted for vertical sliding movement on the support 11 and carries the heater platen 14 which is the upper platen and the pallet press against the print station of a print machine so that each pallet will be aligned with the upper platen 14 and lie between the platens 14 and 15. The heat press includes a micro controller and controls 17 that can be programmed as to the duration and temperature of the transfer printing operation. As shown in more detail in FIGS. 3 and 4 the heating platen 14 is fixed to the upper portion of the C frame 12 by the attachment means 21. During operation of the heating press of this invention, the heating platen 14 does not move relative to the C frame 12. Attached to the C frame is the press cylinder 24 which is adapted to raise and lower the pallet support platen 15. The swivel hub 22 allows for relative movement between the press cylinder shaft and the pallet support platen 15.

The C frame 12 is supported by the levelling cylinder 28 which in turn is fixed by the frame 25 to the base 10. The guide rails 26 sliding within the bearings 27 ensure that the C frame slides vertically in response to the pressure in the levelling cylinder 28. The cylinder 28 allows the C frame 12 and its attachments the upper platen 14 and the lower platen and its press cylinder 24 to float downwardly toward relative to base 10 as the lower platen is raised to maintain abutting support for the pallet. The leveling cylinder 28 may be an hydraulic cylinder but is preferable a pneumatic ram.

In operation the leveling cylinder 28 is pressured to ensure that the pallet of the rotary screen printing machine is located underneath the platen 14 and above the pallet support platen 15. When the pressing operation commences the press cylinder 24 raises the lower platen 15 relative to frame 12 so that is abuts and supports the pallet and pallet arm. The air in the pneumatic cylinder 28 is allowed to bleed so that the cylinder 28 acts as a spring and takes the weight of the C frame 12 and its attachments. This means that the full weight of the C frame 12, the platens 14 and 15 is countered by the levelling cylinder 28 while the pallet is supported by the press cylinder 24. By this arrangement damage to the pallet arm of the screen printing machine is avoided.

The sequence of operation of the heat press when used in conjunction with a rotary screen printing machine is:

1. The pallet of the rotary screen printing machine swings into position between the top (heated) platen and bottom (support) platen
2. the pallet is raised toward the heated platen by the rotary screen printing machine mechanism
3. the lower platen driven by press cylinder 24, is raised to contact the pallet
4. the bleeding of air from levelling cylinder 28 means that the frame and top platen are counterbalanced by the press cylinder driven lower platen
5. heat is applied to the garment on the platen by the top platen which is in contact with the garment on the pallet
6. the bottom platen is lowered
7. the pallet is lowered
8. the pallet swings out and the next pallet swings in to repeat the cycle.

A safety cage may be provided on either side of the heat press so that the space between the platens and the pallet is closed off to avoid accidental injury by the insertion of a hand or limb during operation of the heat press. When provided the safety barrier is raised between steps 3 and 4 and lowered between steps 7 and 8.

The transfer foils may be placed on the garment on the pallet of the rotary screen printer prior to the pallet swinging into position under the top platen. Alternatively the transfer foil may be mounted on a reel feed which passes the web from a feed roll mounted on one side of the heat press frame 12, under the top platen to a take up roll mounted on the other side of the frame. The take up roll controls the tension of the web and a control mechanism ensures that the web is indexed to move each successive foil image to the correct position under the top platen so that the image is transferred from the foil to the garment.

Those skilled in the art will realize that other embodiments of the invention are possible without departing from the essential principle of this invention. Those skilled in the art will also realize that this invention provides a reliable and unique means of transfer printing on screen printing machine pallets without compromising the operation of the screen printing machine.

What is claimed is:

1. A printing machine arm and press combination in which the printing machine has a pallet arm for supporting an article to be printed and the press comprises:

a platen frame, adapted to encompass the pallet arm, the frame being vertically moveably mounted on a support;

an upper platen fixedly mounted to the platen frame and adapted to lie above the pallet arm;

a lower platen movably mounted to the platen frame, the lower platen being positioned below the pallet arm and further being upwardly moveable to abut the pallet arm; and control means for allowing the frame and the upper platen connected thereto to move downwardly to abut the top of the pallet arm when the lower platen is raised to abut the bottom of the pallet arm.

2. A transfer heat press as claimed in any preceding claim 1 in which the lower platen reciprocates relative to the press frame.

3. A transfer heat press comprising:

a platen frame movably mounted on a support for moving vertically relative to said support;

an upper platen fixedly mounted to the platen frame;

heating means located in said upper platen;

a lower platen moveably mounted on the platen frame to allow the lower platen to move upwards toward the upper platen; and control means for allowing the frame and the upper platen connected thereto to move downwardly to abut the top of the pallet arm when the lower platen is raised to abut the bottom of the pallet arm.

4. A transfer heat press as claimed in claim 3 in which the platen frame is a C shaped frame.

5. A transfer heat press as claimed in claim 3 in which the platen frame is supported by a pneumatic or hydraulic ram.

* * * * *